US005428927A

United States Patent [19]

Webb et al.

[11] Patent Number: 5,428,927

[45] Date of Patent: Jul. 4, 1995

[54] FENCE POST ANCHOR DEVICE

[76] Inventors: Leamon Webb, Rte. 1, Box 830; Quinton Webb, Rte. 1, Box 831, both of Webber Falls, Okla. 74470; Ralph Moses, Rte. 1, Box 1765, Warner, Okla. 74469

[21] Appl. No.: 240,975

[22] Filed: May 10, 1994

[51] Int. Cl.[6] ..... E02D 5/74

[52] U.S. Cl. ..... 52/156; 52/162; 256/DIG. 5

[58] Field of Search ..... 52/4, 23, 156, 162, 52/163, 165, 166; 256/1, DIG. 5

[56] References Cited

U.S. PATENT DOCUMENTS

| | | | |
|---|---|---|---|
| 369,371 | 9/1887 | Tourgee | 52/156 |
| 542,976 | 7/1895 | Mesnard | 52/156 X |
| 1,169,821 | 2/1916 | Hindmarsh . | |
| 2,334,989 | 11/1943 | Brickman | 52/162 |
| 2,910,149 | 10/1959 | Lionberger | 52/162 X |
| 3,927,494 | 12/1975 | Struben | 52/23 |
| 4,023,314 | 5/1977 | Tanner | 52/23 |
| 4,663,902 | 5/1987 | Abbott, Jr. . | |

*Primary Examiner*—Lanna Mai
*Attorney, Agent, or Firm*—Head & Johnson

[57] ABSTRACT

An anchor device for a fence post having an extending leg with an opening near the base end thereof. The anchor device includes an elongated anchor having a longitudinal slot therein to receive a portion of the post leg. A pin engages the anchor and passes through the leg opening transverse to the anchor and slot, the anchor being pivotal about the pin.

11 Claims, 1 Drawing Sheet

FENCE POST ANCHOR DEVICE

BACKGROUND OF THE INVENTION

1. Field of the Invention

The present invention is directed to an anchor device for a fence post that will resist withdrawal of the post after installation.

2. Prior Art

Once a fence post has been installed in the ground, it may be subject to upward or tilting forces for a number of reasons. The fence post may be subject to upward movement by ground heaving due to changes in the weather. The ground post may be subject to upward movement where the post is in a low lying area compared to other posts. When the posts are connected by wires to form a fence, the wires may provide an upward force. Finally, the posts may be stolen, vandalized or otherwise tampered with.

Problems from fence post withdrawal have previously been recognized. Abbott, Jr. (U.S. Pat. No. 4,663,902) discloses a strap around a cylindrical fence post which may be retrofitted to an existing installed post. Hindmarsh (U.S. Pat. No. 1,169,821) discloses swinging anchor plates which are produced as a part of the fence post.

Many fence posts used in ranching and agricultural applications are T-shaped in cross-section with a pair of arms and an extending leg. The fence post is constructed of a rigid metal so that it may be hammered or otherwise driven into the ground. These fence posts often have a opening in the leg at the base of the post.

There remains a need for a fence post anchor device that may be secured to existing T-shaped fence posts and installed prior to driving the post into the ground.

There remains a need for a fence post anchor device that can be driven into the ground with the fence post without axial slippage or movement.

SUMMARY OF THE INVENTION

The present invention provides an anchor device for a fence post. The fence post has an extending leg and a base end which will typically include an opening in the leg.

An elongated anchor includes a longitudinal slot. The anchor is composed of two sections, a substantially flat first portion joined to a substantially flat second portion. The first portion is in angular relation to the second portion.

A pin will engage the anchor and will pass across the slot transverse to the anchor and to the slot. Additionally, the pin will pass through the opening in the base end of the leg of the fence post. The anchor is pivotal and is allowed to rotate about the pin. The pin thus forms a central axis about which the first portion and the second portion move radially.

The base end of the extending leg is received within the slot. Accordingly, the first portion extends beyond the base of the post and becomes the leading edge when the fence post is driven into the ground during installation.

During installation, the first portion is substantially parallel to the fence post. After installation, and in the event of an upward force on the fence post, the anchor will be permitted to pivot or rotate.

DETAILED DESCRIPTION OF THE PREFERRED EMBODIMENTS

Figure 1:
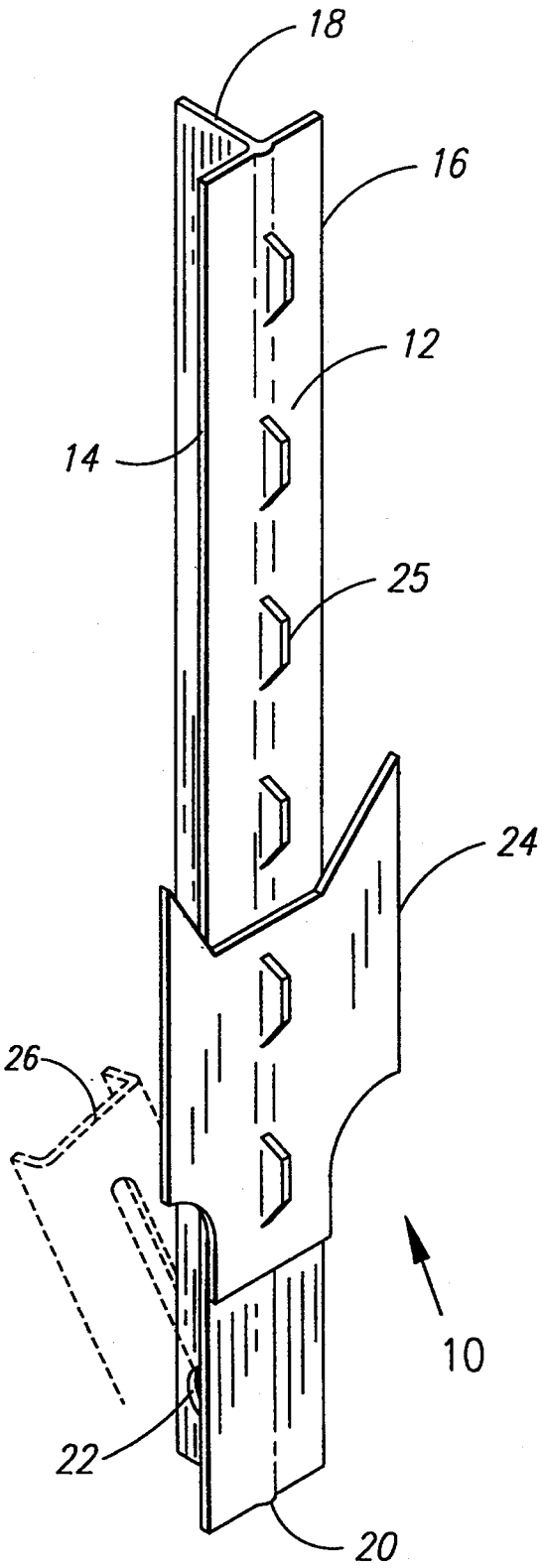
FIG. 1 illustrates a perspective view of a T-shaped fence post with the anchor device of the present invention shown in dashed lines.
Figure 2:
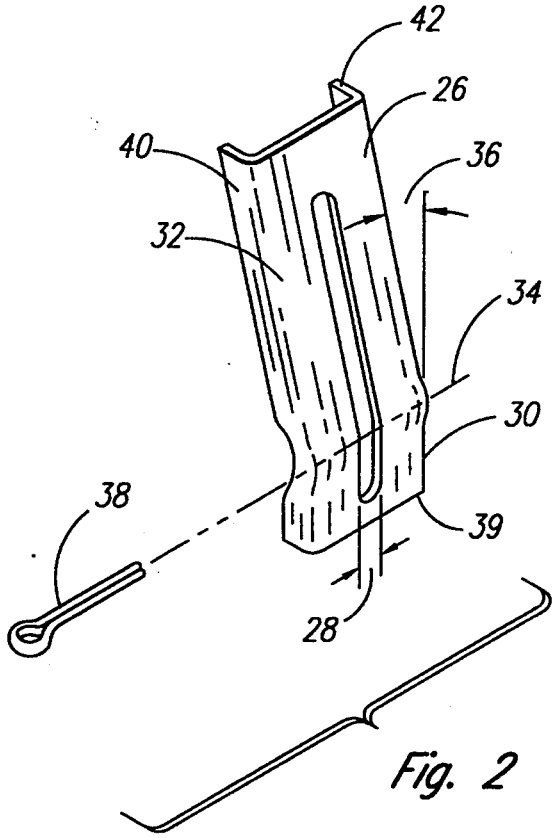
FIG. 2 illustrates the anchor portion of the anchor device shown in FIG. 1.

Referring to the drawings in detail, FIG. 1 and FIG. 2 illustrate a perspective view of an anchor device for a fence post as constructed in accordance with the present invention.

A fence post 12, constructed of steel or other sturdy material, has a T-shaped cross-section with a pair of arms 14 and 16 and an extending leg 18. The fence post 12 has a base end 20 which will typically include an opening 22 in the leg 18.

The fence post also may include an optional spade 24 which is used to promote rigidity once the fence post is installed and may include knobs 25 which are used to restrict movement of the wire or other fence material.

The device 10 includes an elongated anchor 26, shown apart from the fence post in FIG. 2 and shown in dashed lines in FIG. 1. In the embodiment shown, the anchor 26 is approximately 4 inches by 1¼ inches although other sizes are possible. The anchor 26 includes a longitudinal slot 28.

The anchor 26 may be composed of two sections, a substantially flat first portion 30 joined to a substantially flat second portion 32. The first portion 30 joins with the second portion 32 at dashed line 34 shown in FIG. 2. In the embodiment shown, the first portion 30 is in angular relation to the second portion. With dashed line 34 as the center axis, the first portion is approximately 78° from the second portion. Stated another way, the second portion is approximately 12° from alignment with the first portion. The angular relation of the first portion to the second portion is seen by arrow 36.

A pin 38 will engage the anchor 26 and will pass across the slot 28 transverse to the anchor 26 and the slot 28.

Figure 3:
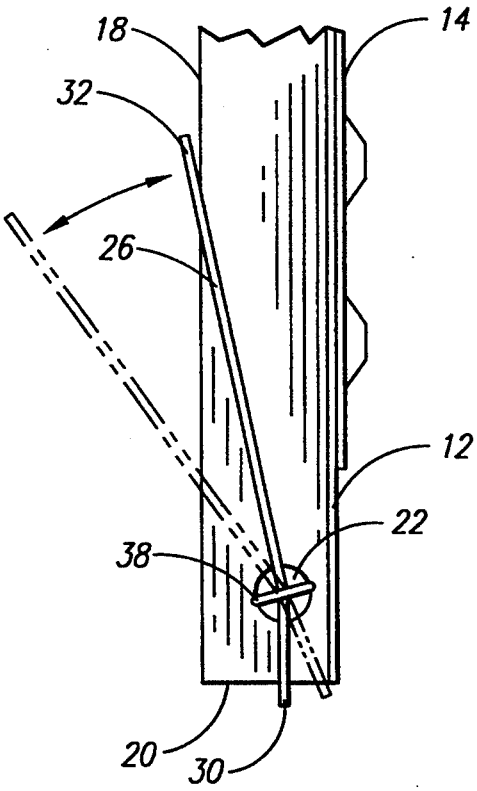
FIG. 3 illustrates a side view of the fence post anchor device shown in FIG. 1 installed on a T-shaped fence post.

As best seen in FIG. 3, the pin 38 will pass through the opening 22 in the base end 22 of fence post 20. The pin 38, when installed, resides along dashed line 34 (seen in FIG. 2), at the joinder of the first portion with the second portion. Accordingly, the anchor 26 is pivotal and is allowed to rotate about the pin 38. The pin thus forms a central axis about which the first portion and second portion move radially. In the embodiment shown, the pin 38 is a cotter pin, although other types of pins or fasteners might be employed.

As may also be seen in FIG. 3, the base end 20 of the extending leg 18 is received within the slot 28. Accordingly, the first portion 30 extends beyond the base of the post 12. The edge 39 of the first portion 30 becomes the leading edge when the fence post is driven into the ground during installation.

As best seen in FIG. 2, the first portion and second portion of the anchor may be provided with stiffening lips 40 and 42 which resisting bending or misshaping of the anchor 26. The stiffening lips are, in the present embodiment, simply bent from the flat plane of the first and second portions. Accordingly, a thin grade of steel may be used to form the anchor. In one embodiment, a 1/32 inch thick sheet metal has proven adequate to withstand all forces thereon.

The device may be simply and quickly installed on site in the field where it is deemed necessary. To install, an anchor 26 is brought to the base end 20 of the fence post. The longitudinal slot 28 is slipped over the base end 20 of the fence post so that the base of the extending leg 18 resides within the slot 28. The cotter pin 38 may then be slipped transversely across the anchor as illustrated by dashed line 34 in FIG. 2. The pin is slipped across or transverse to the slot and through the opening 22 in the leg and, thereafter, through the remainder of the anchor 26. In this manner, the anchor 26 is secured to the leg 18 of the fence post while being permitted to rotate or pivot about the pin 38.

Once the anchor is affixed to the fence post, the post may be driven into the ground. This is accomplished in the traditional manner—such as by hammering the top of the fence post. The base 22 is thereby buried. The edge 39 of the first portion 30 becomes the leading edge in inserting the fence post into the ground, as best seen in FIG. 3. Since the anchor 26 is being driven into the ground with the fence post, it can not slip or move axially. This also relieves any stress on the cotter pin.

During installation, the first portion 30 is nearly parallel to the arms 14 and 16 of the fence post. Accordingly, the anchor itself is driven into the ground along with the fence post. It has been found that the anchor does not hinder installation of the fence post and, in fact, assists in installing the fence post.

After installation, and in the event of the an upward force on the fence post 12, the anchor 26 will be permitted to pivot or rotate to the position as shown by the dashed lines in FIG. 3. Accordingly, a resistance is provided to deter withdrawal of the fence post 12.

Whereas, the present invention has been described in relation to the drawings attached hereto, it should be understood that other and further modifications, apart from those shown or suggested herein, may be made within the spirit and scope of this invention.

What is claimed is:

1. An anchor device for a fence post having an extending leg with an opening near a base of said post, which anchor device comprises:

an elongated anchor having a longitudinal slot therein, said base of said leg receivable in said longitudinal slot; and a pin engaging said anchor and passing through said leg opening, said anchor being pivotal about said pin.

2. An anchor device as set forth in claim 1 wherein said pin is transverse to said anchor and said slot.

3. An anchor device as set forth in claim 1 wherein said anchor has a substantially flat first portion joined to a substantially flat second portion, said first portion in angular relation to said second portion.

4. An anchor device as set forth in claim 3 wherein said first portion is approximately 78 degrees from said second portion.

5. An anchor device as set forth in claim 3 wherein said first and second portions have stiffening lips to resist bending thereof.

6. An anchored post which comprises:

a post having an extending leg, said leg with an opening near a base of said post;

an elongated anchor having a longitudinal slot therein to receive a portion of said leg; and a pin engaging said anchor and passing through said opening in said leg, said anchor being pivotal about said pin.

7. An anchored post as set forth in claim 6 wherein said pin is transverse to said anchor and said slot.

8. An anchored post as set forth in claim 6 wherein said anchor has a substantially flat first portion joined to a substantially flat second portion, said first portion in angular relation to said second portion.

9. An anchored post as set forth in claim 8 wherein first portion is approximately 78° from said second portion.

10. An anchored post as set forth in claim 8 wherein said leg end is received in said slot.

11. An anchored post as set forth in claim 8 wherein said first and second portions have stiffening lips to resist bending thereof.

* * * * *